US005204873A

United States Patent [19]

Imagawa

[11] Patent Number: 5,204,873

[45] Date of Patent: Apr. 20, 1993

[54] DC ELECTRIC ARC MELTING APPARATUS

[75] Inventor: Hiroshi Imagawa, Gifu, Japan

[73] Assignee: Daidotokushuko Kabushikikaisha, Japan

[21] Appl. No.: 843,111

[22] Filed: Feb. 28, 1992

[30] Foreign Application Priority Data

Mar. 2, 1991 [JP] Japan ..... 3-61217

[51] Int. Cl.[5] ..... H05B 7/144

[52] U.S. Cl. ..... 373/108; 373/43; 373/47; 373/78; 373/102; 373/103; 373/104

[58] Field of Search ..... 373/108, 102-104, 373/43, 46, 47-49, 78

[56] References Cited

U.S. PATENT DOCUMENTS

| | | | |
|---|---|---|---|
| 993,105 | 5/1911 | Reid | 373/43 |
| 1,331,625 | 2/1920 | Critchett | 373/48 |
| 1,913,161 | 6/1933 | Jonas | 373/47 |
| 3,612,740 | 10/1971 | Gierek | 373/78 |
| 3,950,601 | 4/1976 | Popov et al. | 373/43 |
| 4,001,487 | 1/1977 | Schumacher et al. | 373/47 |

FOREIGN PATENT DOCUMENTS 1-167577 7/1989 Japan .

*Primary Examiner*—Bruce A. Reynolds
*Assistant Examiner*—Tu Hoang
*Attorney, Agent, or Firm*—William A. Drucker

[57] ABSTRACT

Two DC electric arc furnaces are provided side by side. The both DC electric arc furnaces are connected by a duct. Each of two power source apparatuses is mounted near and associated with each of the DC electric arc furnaces. The anodes of the both power source apparatuses are mutually connected by an anode cable and the cathodes of the apparatuses by a cathode cable. The anodes and the cathodes of the both DC elecric furnaces are connected to the anode cable and the cathode cable, respectively, via a connection circuit adapted to supply electric power alternately to either of the DC electric arc furnaces. When a raw material is molten in one of the DC electric arc furnaces, electric power is supplied by the both power source apparatuses to this DC electric arc furance. The exhaust gas at a high temperature produced in this DC electric arc furnace is sent to the other DC electric arc furnace through the duct and preheats another raw material charged there beforehand.

1 Claim, 2 Drawing Sheets

DC ELECTRIC ARC MELTING APPARATUS

BACKGROUND OF THE INVENTION

1. Field of the Invention

This invention relates to a DC electric arc melting apparatus to melt various raw materials by electric arc heating.

2. Description of the Prior Art

In order to melt raw materials, a DC electric arc furnace, for example, is used. When the raw materials are molten in the DC electric arc furnace, exhaust gas at a high temperature is produced there. There is a technique to effectively utilize the heat of the exhaust gas. Namely, in addition to a DC electric arc furnace 11*f* including a power source apparatus 61, another DC electric arc furnace 12*f* is additionally provided and the both furnaces are connected by ducts 24*f* and 25*f* as shown in FIG. 4. The exhaust gas at a high temperature produced in the first DC electric arc furnace 11*f* in melting operation is sent to the second DC electric arc furnace 12*f* through the ducts 24*f* and 25*f*. In the second DC electric arc furnace 12*f*, a raw material charged beforehand is preheated by utilizing the heat of the exhaust gas. After the melting operation in the first DC electric arc furnace 11*f* is finished, the melting operation in the second DC electric arc furnace is performed. In this case, the power source apparatus 61 of the first DC electric arc furnace 11*f* is utilized as that for the second furnace. Namely, change-over switches 62 and 63 are interposed in a connection circuit between the power source apparatus 61 and the first DC electric arc furnace 11*f*. These switches 62 and 63 are connected to the second DC electric arc furnace 12*f* by an anode cable 43*f* and a cathode cable 44*f*, respectively. Electric power is supplied from the power source apparatus 61 to the second DC electric arc furnace 12*f* by changing over the switches 62 and 63. The melting operation in the second DC electric arc furnace 12*f* can be performed with less electric energy since the raw material there has already been preheated. Again in this case, the exhaust gas at a high temperature produced in the second DC electric arc furnace 12*f* is sent into the first DC electric arc furnace 11*f* through the ducts 25*f* and 24*f* and is used for the preheating there. The above mentioned technique to utilize the exhaust gas for the preheating is disclosed, for example, in a Japanese published unexamined patent application No. 1-167577.

Now, the above mentioned both DC electric arc furnaces 11*f* and 12*f* are connected by the ducts 24*f* and 25*f*, each DC electric arc furnace is provided with a tap hole and a slagging door, and a furnace roof elevating and swinging apparatus is provided close to each electric arc furnace. Furthermore, spaces for works of tapping out molten metal and slag and repairing the furnace are necessary around each furnace.

According to the technique shown in FIG. 4, however, a power source apparatus capable of supplying 100% of the operating power of any one of the DC electric arc furnaces as the power source apparatus 61. There appears a problem that such a power source apparatus is large-sized and therefore is difficult to be mounted around the furnace having the above mentioned various spatial restrictions. Moreover, the full current to operate the second DC electric arc furnace 12*f* flows through the anode cable 43*f* and the cathode cable 44*f* connecting the DC electric arc furnace 12*f* to the switches 62 and 63, respectively and so these cables have to have a sufficiently large cross section to pass the full operating current. Cables having a large cross section are expensive. Furthermore, the work of laying the cables is difficult. Namely, the cables must be laid at places kept away from the above mentioned ducts 24*f* and 25*f*, the tap hole, the slagging door and the spaces for the above mentioned works. Consequently, the cables must be bent and be supported at various points. The work of bending and supporting the cables having a large cross section is extremely difficult since these cables are less flexible and heavy.

SUMMARY OF THE INVENTION

A first object of the present invention is to provide a DC electric arc melting apparatus wherein when a raw material is molten in a first DC electric arc furnace, another raw material in a second DC electric arc furnace can be preheated, at a place causing the least loss of heat and as close as possible to the first furnace, by making use of the exhaust gas at a high temperature produced in the first DC electric arc furnace. When such preheating is available, there is a usefulness that the melting operation of the preheated raw material in the second DC electric arc furnace can get off with less electric energy than that of a cool raw material.

A second object of the present invention is to provide a DC electric arc melting apparatus wherein when electric power is supplied to the first DC electric arc furnace for the melting operation there, the electric power is supplied not only by the power source apparatus for the first DC electric arc furnace but also by the power source apparatus for the second DC electric arc furnace where the raw material is preheated but any electric power is not consumed.

When not only the power source apparatus for the first DC electric arc furnace but also that for the second DC electric arc furnace can be utilized in this manner, there is an advantage that a cheap power source apparatus with an output equal to a half of the operating electric power of the first DC electric arc furnace suffices as the power source apparatus for the first DC electric arc furnace.

A third object of the present invention is to provide a DC electric arc melting apparatus wherein when the raw material is molten in the second DC electric arc furnace, by contrast to the case of the above mentioned objects, as well, the raw material can be preheated in the first DC electric arc furnace by making use of the exhaust gas produced in the second DC electric arc furnace. The third object is as well to provide a DC electric arc melting apparatus wherein when electric power is supplied to the second DC electric arc furnace for the melting operation there, the electric power is supplied not only from the power source apparatus for the second DC electric arc furnace but also from the power source apparatus for the first DC electric arc furnace and, in addition, a power source apparatus with an output equal to a half of the operating electric power of the second DC electric arc furnace suffices as the power source apparatus for the second DC electric arc furnace.

A fourth object of the present invention is to provide a DC electric arc melting apparatus wherein the power source apparatuses, provided for the first and second DC electric arc furnaces, respectively, are small-sized and can be mounted in a small empty space available around each of the DC electric arc furnaces.

Either of the power source apparatuses for the first and second DC electric arc furnaces is small-sized since the power source apparatuses have only to have an output equal to a half of the operating electric power of the DC electric arc furnace as is mentioned above. Accordingly, there is an advantage that even though the use of the space around the DC electric arc furnace is restricted due to the above mentioned tap hole and slagging door and the spaces for the works, the small-sized power source apparatuses can be mounted in a small empty space apart from such members and the spaces for the works. In other words, this is a feature that the small-sized power source apparatus, mounted in such small empty space, do not interfere at all with the works around the furnaces.

A fifth object of the present invention is to provide a DC electric arc melting apparatus wherein, among the power supply cables connecting the DC electric arc furnaces to the power source apparatuses, the anode cable connecting the anodes of the both power source apparatuses and the cathode cable connecting the cathodes of them can be both relatively thin.

In order to supply electric power to the first and second DC electric arc furnaces in the above mentioned manner, the anode cable connecting the anodes of the both power source apparatuses and the cathode cable connecting the cathodes of them are necessary. According to the present invention, however, when either the first or the second DC electric arc furnace is operated, half the operating electric power necessary for the operated DC electric arc furnace is supplied by the power source apparatus for the operated DC electric arc furnace and the other half is supplied by the power source apparatus for the other DC electric arc furnace through the above mentioned anode and cathode cables. Namely, only half the full current necessary for operating the DC electric arc furnaces flows in the anode and cathode cables. Consequently, these anode and cathode cables have only to have half the cross section necessary for passing the full operating current. Namely, the cables may be thin. Such thin cables are cheap and the work of laying the cables is easy.

DESCRIPTION OF THE PREFERRED EMBODIMENT

Figure 1:
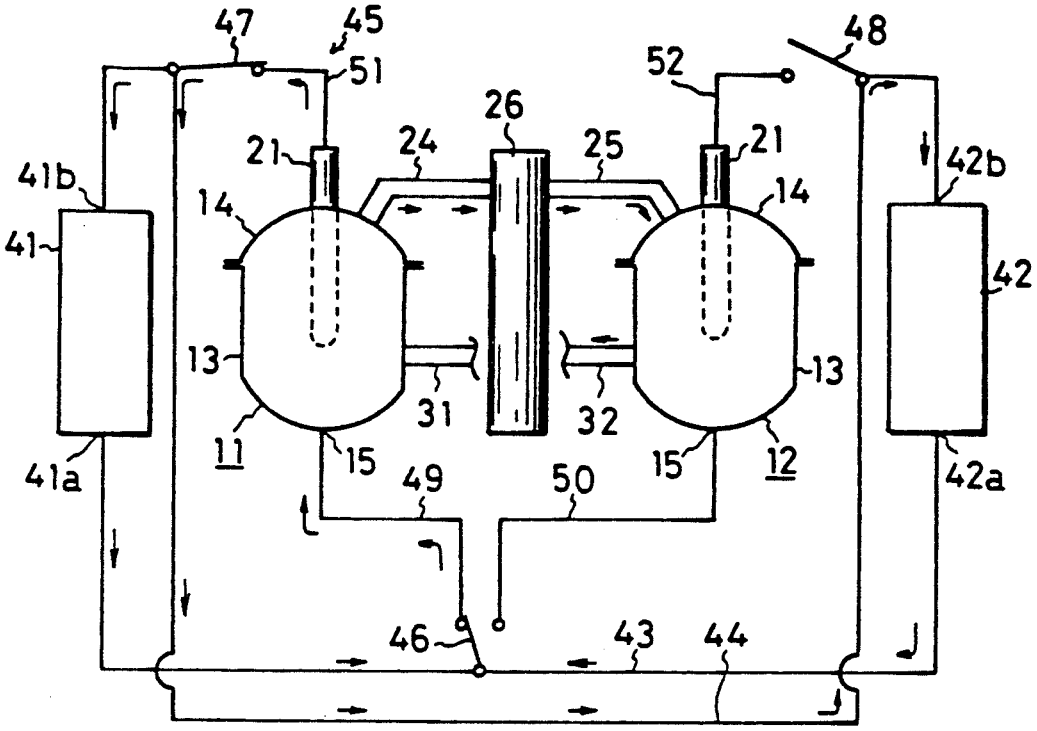
FIG. 1 is a front elevation showing schematically the positional relationship of various members in a first embodiment of a DC electric arc melting apparatus.
Figure 2:
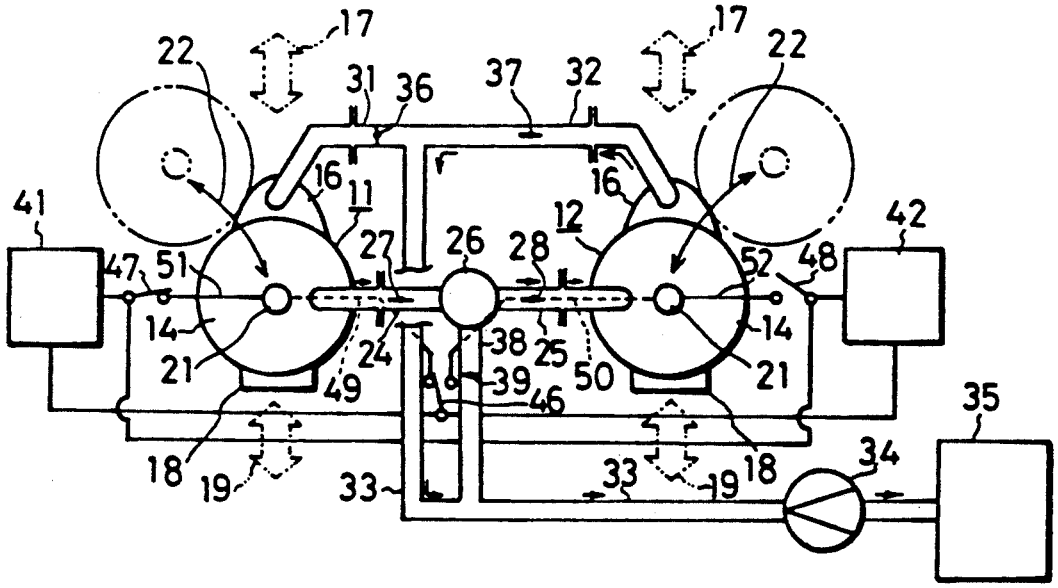
FIG. 2 is a plane view of the DC electric arc melting apparatus of FIG. 1.

In FIGS. 1 and 2, a first and a second DC electric arc furnaces 11 and 12 are provided side by side. These DC electric furnaces 11 and 12 are located as close to each other as possible so that when the exhaust gas produced in one of the DC electric arc furnaces is sent to the other as is described hereinafter, the heat loss from the gas may be the least. Each DC electric arc furnace 11 or 12 includes a furnace body 13 and furnace roof 14 covering it. A bottom electrode (anode) 15 is mounted in a hearth bottom of the furnace body 13. The furnace body 13 is formed, at a part of the side wall thereof, with a protrusion 16 and is provided with a tap hole under the protrusion 16. Under the tap hole, ladle for taking out molten metal put on a truck is carried in or out in the direction shown by an arrow 17. The furnace body 13 is formed with a slagging door 18 at another part of the side wall of the body 13, for example, at the part opposite to the protrusion 16 as shown. The works of taking out slag and repairing the furnace are performed through the slagging door 18 and along the direction shown by an arrow 19. A top electrode (cathode) 21 is mounted in the furnace roof 14. The furnace roof 14 is moved to a retreat place shown by alternate long and two short dash lines or is put again onto the furnace body 13 in the direction shown by an arrow 22 by a well known furnace roof elevating and swinging apparatus not shown.

One end of a preheating duct 24 or 25 is connected to the furnace roof 14 of the DC electric arc furnace 11 or 12. The other ends of the preheating ducts 24 and 25 are connected to a combustion tower 26 provided between the DC electric arc furnaces 11 and 12 and the ducts 24 and 25 communicate with each other through the combustion tower 26. Each preheating duct 24 or 25 is provided therein with a damper 27 or 28. One end of an exhaust duct 31 or 32 is connected to the protrusion 16 in the DC electric arc furnace 11 or 12. The other ends of these exhaust ducts 31 and 32 are connected to a common exhaust duct 33. The exhaust duct 33 is connected to a dust collector 35 via a blower 34. The exhaust duct 31 or 32 is provided therein with a damper 36 or 37. The combustion tower 26 is connected to the exhaust duct 33 by a by-pass duct 38 including therein a damper 39.

Now an electric system is described. A power source apparatus 41 or 42 is mounted near each DC electric arc furnace 11 or 12. These power source apparatuses are those which are adapted to transform AC input power into DC output power with use of thyristors. Half the operating electric power of one DC electric arc furnace i.e. the DC electric furnace 11 or 12 is sufficient as the output of each power source apparatus 41 or 42. Anodes 41*a* and 42*a* of the both power source apparatuses are connected to each other by an anode cable 43. Cathodes 41*b* and 42*b* are connected to each other by a cathode cable 44. As these cables 43 and 44, those cables are used which have a cross section sufficient for passing only half the full operating current of the DC electric arc furnace 11 or 12. The first DC electric arc furnace 11 and the second one 12 are connected to the cables 43 and 44 through a connection circuit 45 which is adapted to supply electric power interchangeably to the DC electric furnace 11 or 12. In the present embodiment, the connection circuit includes three switches 46, 47 and 48 for change-over operation. As the switch 46, a change-over switch is used and is located at the midway point between the both DC electric arc furnaces 11 and 12. On the other hand, simple making and breaking switches are used as the switches 47 and 48 which are located near the top electrodes 21 of the first and second DC electric arc furnaces 11 and 12, respectively. Numerals 49 through 52 represent connection cables connecting respective switches to the bottom electrodes 15, the anodes of the DC electric arc furnaces and to the top electrodes 21, the cathodes of the furnaces. As these cables 49 through 52, those cables are used which have a cross section sufficient for passing the operating full current.

In the next place, the operation of the DC electric arc melting apparatus is explained. First of all, the first DC electric arc furnace 11 is operated as follows. A raw material such as a scrap raw material or a reduced iron material is charged into the first DC electric arc furnace 11. The work of charging the raw material is performed with the furnace roof 14 opened as is well known. The raw material to be charged may be either preheated or not. On the other hand, a raw material not preheated is charged into the second DC electric arc furnace 12. The switches 46 through 48 are changed over beforehand to the states shown in the figures and the dampers 27, 28, 36, 37 and 39 are kept in the states shown in the figures. With these states, the both power source apparatuses 41 and 42 are turned on. Then the DC electric power output by the both power source apparatuses 41 and 42 is supplied to the first DC electric arc furnace 11. An electric arc is struck by the supplied electric power in the first DC electric arc furnace 11 and the charged raw material is molten by the heat produced by the electric arc. While the melting operation in the first DC electric arc furnace 11 proceeds in this manner, exhaust gas at a high temperature is produced. The exhaust gas is sent to the second DC electric arc furnace 12 through the ducts 24 and 25. In the second DC electric arc furnace 12, the raw material charged beforehand is preheated by the supplied exhaust gas. The exhaust gas, which has been made use of for the preheating, is sent to the dust collector 35 through the ducts 32 and 33. In this case, the amounts of opening of the respective dampers are adjusted so that a suitable amount of the exhaust gas from the first DC electric arc furnace 11 may flow to the second DC electric arc furnace 12 for the preheating and the rest of the exhaust gas may flow to the dust collector 35 without going to the second DC electric arc furnace 12. The above mentioned flow of the exhaust gas is formed, of course, by the operation of the blower 34.

In the case of the melting operation in the first DC electric arc furnace 11, the raw material may be additionally charged as occasion demands. After the melting operation in the first DC electric arc furnace 11 is finished, the both power source apparatuses 41 and 42 are turned off and the molten metal in the first DC electric arc furnace 11 is tapped out through the tapping hole. The first DC electric furnace 11 is repaired as occasion demands.

After the operation in the first DC electric arc furnace 11 is finished in the above mentioned manner, the operation in the second DC electric arc furnace 12 is successively performed as follows in the same manner as in the case of the first DC electric arc furnace 11. A new raw material is first charged into the first DC electric arc furnace 11. The switches 46 through 48 are changed over to the states opposite to those shown in the figures. The dampers 36 and 37 are turned to the states opposite to those shown in figures. With these states, the power source apparatuses 41 and 42 are again turned on. Then the DC electric power output by the both power source apparatuses 41 and 42 is supplied to the second DC electric arc furnace 12, where the raw material is molten. The exhaust gas at a high temperature produced at this time is sent to the first DC electric arc furnace 11 through the ducts 25 and 24 and the raw material having been charged beforehand in the first DC electric arc furnace 11 is preheated by the exhaust gas. The exhaust gas, which has been made use of for the preheating, is sent to the dust collector 35 through the ducts 31 and 33.

When the raw material is molten in the second electric arc furnace 12, a less electric energy is sufficient for melting the raw material since the raw material has been preheated to a raised temperature. After the melting operation in the second DC electric arc furnace 12 is finished, the both power source apparatuses 41 and 42 are turned off and the molten metal in the second DC electric arc furnace 12 is tapped out.

The above mentioned operations in the first DC electric arc furnace 11 and in the second one 12 are repeated alternately.

Figure 3:
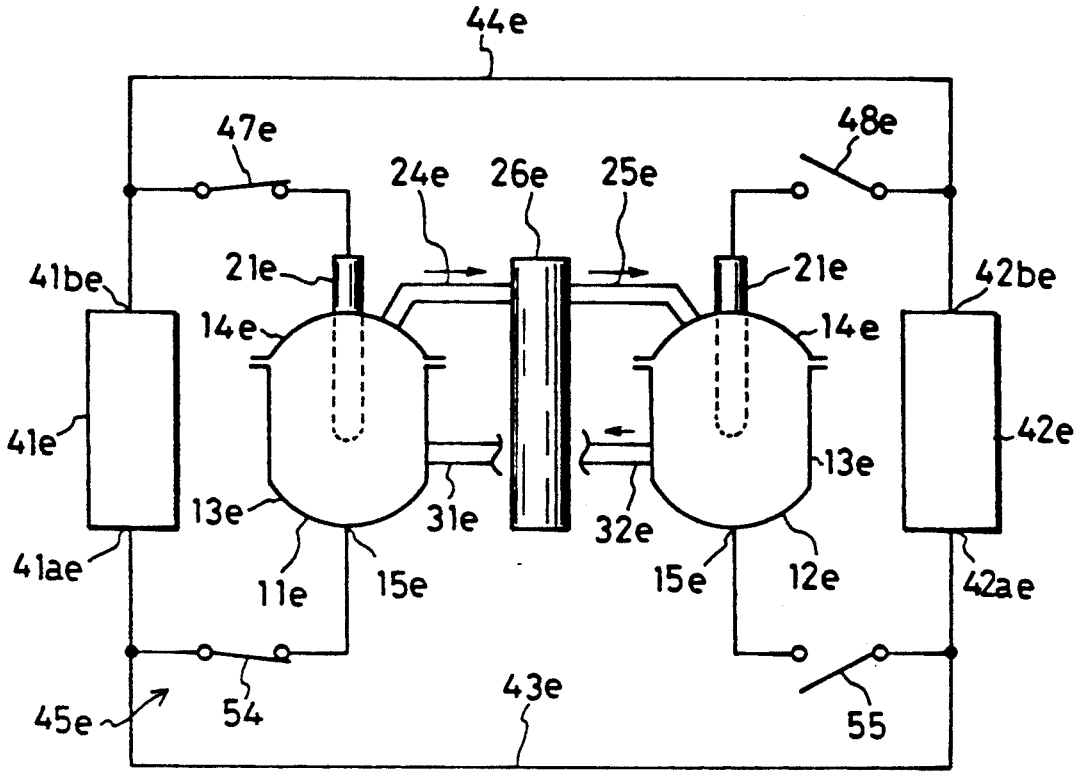
FIG. 3 is a front elevation showing schematically the positional relationship of various members in a second embodiment of the DC electric arc melting apparatus.
Figure 4:
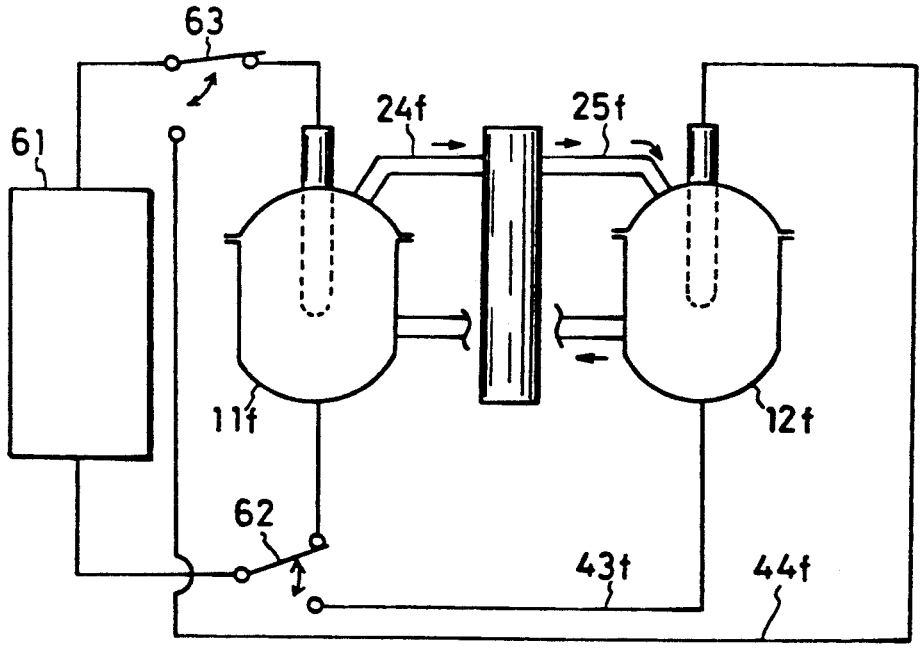
FIG. 4 (PRIOR ART)
FIG. 4 is a front elevation showing schematically the positional relationship of various members in a conventional DC electric arc melting apparatus.

In the next place, a different embodiment of the present invention is shown in FIG. 3. In this embodiment, a connection circuit between an anode cable **43*e* and anodes 15*e* of first and second DC electric arc furnaces includes two switches 54 and 55 instead of the aforementioned change-over switch 46. In this embodiment, when the first DC electric arc furnace 11*e* is operated, the switches 47*e* and 54 are made and the switches 48*e* and 55 are broken. On the other hand, when the second DC electric arc furnace 12*e* is operated, the switches 47*e* and 54 are broken and the switches 48*e* and 55** are made. Those members in the present embodiment which are considered to be equivalent in view of construction and operation are given the same reference numerals but with an alphabet "e" as those of the corresponding members in the previous embodiment and the explanation of the members is not repeated.

What is claimed is:

1. A DC electric arc melting apparatus comprising first and second DC electric arc furnaces provided with respective anodes and cathodes and being provided side by side, and a duct connecting said first and second DC electric arc furnaces to conduct an exhaust gas from said first DC electric arc furnace to said second one and vice versa, characterized in that power source apparatuses each having an output equal to a half of the operating electric power of said each DC electric arc furnace are located near the first and second DC electric arc furnaces respectively, anodes of said both power source apparatuses are connected mutually by an anode cable, cathodes of said both power source apparatuses are connected mutually by a cathode cable, and said anodes and cathodes of said first and second DC electric arc furnaces are connected to said anode cable and said cathode cable, respectively, through a connection circuit having a switch adapted to supply electric power alternately to either of said first and second DC electric arc furnaces.

* * * * *